US006602101B2

(12) United States Patent
deDoes

(10) Patent No.: US 6,602,101 B2
(45) Date of Patent: Aug. 5, 2003

(54) LOOP BOTTOM BUOY STICK

(76) Inventor: Eric deDoes, 3628 Turner Ridge Rd., Somerville, ME (US) 04348

( * ) Notice: Subject to any disclaimer, the term of this patent is extended or adjusted under 35 U.S.C. 154(b) by 0 days.

(21) Appl. No.: 09/779,231

(22) Filed: Feb. 8, 2001

(65) Prior Publication Data

US 2002/0106948 A1 Aug. 8, 2002

(51) Int. Cl.[7] ..... B63B 22/00
(52) U.S. Cl. ..... 441/1; 441/6; 441/23
(58) Field of Search ..... 441/1, 6, 21, 22, 441/23, 24, 25, 26, 27, 3; D10/107; 43/44.91, 44.95, 44.87

(56) References Cited

U.S. PATENT DOCUMENTS

| | | | | | |
|---|---|---|---|---|---|
| 157,785 | A | | 12/1874 | Brown | |
| 546,057 | A | | 9/1895 | Richard | |
| 1,173,820 | A | | 2/1916 | Logan et al. | |
| 2,841,804 | A | | 7/1958 | Case | |
| 3,866,346 | A | * | 2/1975 | Schneider | 43/44.87 |
| 3,942,203 | A | | 3/1976 | Perkins | |
| 4,249,277 | A | | 2/1981 | Plante | |
| 4,927,394 | A | | 5/1990 | Galgana | |
| D369,567 | S | | 5/1996 | Torngren | |
| 5,713,152 | A | * | 2/1998 | Domack | 24/543 |

FOREIGN PATENT DOCUMENTS

| | | | | |
|---|---|---|---|---|
| IT | 407126 | * | 11/1946 | 441/1 |

* cited by examiner

*Primary Examiner*—Sherman Basinger
(74) *Attorney, Agent, or Firm*—Verrill & Dana, LLP; Chris A. Caseiro

(57) ABSTRACT

A loop bottom buoy stick having a primary upper section and a primary lower section configured to receive a connector in an eyelet at the distal end of the primary lower section. The lower section includes a fixed section and a flap section adjacent to the fixed section. The fixed section is a continuation of the primary upper section and the flap section in combination with the fixed section forms the eyelet. The flap section is arranged to be able to be drawn away from the fixed section to establish a spacing through which the connector can easily pass. Optional spacer inserts may be used to set the positioning of a buoy on the stick.

15 Claims, 3 Drawing Sheets

LOOP BOTTOM BUOY STICK

BACKGROUND OF THE INVENTION

1. Field of the Invention

The present invention relates to buoy sticks. More particularly, the present invention relates to buoy sticks used to retain buoys and that have means for retaining a rope to the stick, either directly or indirectly.

2. Description of the Prior Art

Buoys are used as floating markers to notify fishermen, casual boaters, commercial shippers, marine researchers, etc. of the position of a linkage device in water. The linkage device connects the buoy (a location marker, weather buoy, navigational buoy, etc.) to something that is below the water surface such as, for example, a fishing gillnet, a chain, or a rope that has a distal end connected to some other structure. That other structure may be any one of a wide array of structures located underwater that is of interest to be observed or retrieved. One example of such another structure is a lobster trap. Other such structures include the anchors or weights used to keep weather buoys and navigational buoys in a range of positions.

It is a fairly common practice in fixed-fishing gear fields, such as the lobstering business, for example, to connect a plurality of structures, e.g., lobster traps, to a single marker buoy. That connection may be made by way of a set of ropes in series, with the last one being coupled directly to the buoy. Alternatively, two buoys may be spaced apart from one another, with a series of underwater structures connected together by rope, the first tied to one of the two buoys and the last in the series tied to the other buoy. The linkage or connecting device may be a unitary structure with an eyelet or opening through which the rope (or chain, etc.) passes and to which the rope may be tied. Alternatively, the rope or chain may be wrapped around the linkage device and coupled to a floating structure. In either case, it is of great desire to ensure that the rope or chain remains firmly connected to the floating device. For a lobster trap, it is of interest to keep a rope connected to its corresponding marker buoy so that the trap may be retrieved from the seabed by pulling on the rope. If the rope is not securely fastened to the buoy, the trap and its contents may be irretrievably lost.

Presently, lobster buoys are coupled to the ropes of one or more traps using marker buoys. The buoy may simply be a float or a float in combination with a stick having identifying markings, such as painted designs, flags, or the like, extending from the water surface. The marker stick may be fabricated of wood, plastic or metal, although plastic is increasingly preferred. The opposing end of the stick includes an eyelet to which either the rope is tied or to which an intermediate coupling is connected. The rope is then tied to that intermediate coupling, which may be a swivel coupling. The buoy includes a through hole into which the buoy stick is inserted. When in position, the buoy may rest on the eyelet of the stick. Alternatively, a sleeve of selectable length may be positioned between the eyelet and the bottom of the buoy to set the position of the buoy with respect to the top of the stick.

The buoy sticks currently available are unitary pieces terminating in the eyelet at the bottom. It can be difficult to remove the rope or the coupling from the eyelet for replacement after it has been placed in service. For that reason, some lobstermen custom build flap closure sticks. The flap closure stick includes the main stick body made of hollow PVC pipe. A form of eyelet is established at the base of the hollow stick by bending a flap closure piece. That is, a portion of the eyelet extends up next to the main next body some distance. The extended portion is attached to the main body only at the bottom in the area of the eyelet. The remainder of the flap is not coupled directly to the main body but is spaced closely and tightly to the main body.

The extended portion is a flap that may be forced open to accept a looped rope between the flap and the main stick body. The loop is passed down between the flap and the stick body until it reaches the eyelet where it resides. The flap then springs back in tight association with the main stick body. As a result, the flap captures the rope loop on the eyelet. However, when the rope is to be removed, the flap may be pulled outwardly and the loop slid off the loop and therefore off the stick. That process is much easier and faster than attempting to untie the rope. It also saves rope in that the loop does not have to be cut to remove it quickly from the stick eyelet.

Unfortunately, these homemade flap sticks are made of hollow pieces and therefore fracture under common use conditions. Moreover, under some operational conditions, the rope loop may force the flap open. The loop may then exit the eyelet and pull off the flap. Further, the process of making these flap sticks can be time consuming for the lobsterman and the resultant sticks may vary in size and quality. Therefore, what is needed is a buoy stick that enables easier insertion into and removal of a connecting rope or intermediate coupling on the eyelet. What is also needed is a modified buoy stick including such an easier stick opening means that withstands the operational conditions expected for a buoy stick employed in the ocean. What is also needed is such a modified buoy stick that may be made with consistent characteristics and not requiring homemade modifications.

SUMMARY OF THE INVENTION

In view of the foregoing, it is an object of the present invention to provide a buoy stick that includes a modified extension to improve insertion and removal of a rope or intermediate coupling into or out of the stick's eyelet. It is also an object of the present invention to provide a modified buoy stick with extension that may be opened by the user when desired but that does not succumb to undesired opening under operational conditions. Further, it is an object of the present invention to provide such a modified buoy stick that may be made in a uniform manner using conventional commercial fabrication techniques.

These and other objects are achieved with the present invention, which is a bottom loop buoy stick including a primary stick body and a single structure having an upper substantially solid region and a lower split region. The split region terminates in an eyelet for retaining a rope or coupling that is in turn connected to the rope. The length of the upper region is selectable as a function of the particular overall length of the stick desired, such as a 24", 30", 36", or 48" stick. Although the lower split region may also be of selectable length, for manufacturing purposes it is preferably of a standard length.

The split region of the stick includes a fixed section associated with the upper region, and a flap section that may be forcibly pulled away from the fixed section. The fixed section and the flap section include in combination means for fixing their positions with respect to one another when the stick is in a static condition. That means may be a tongue-in-groove arrangement. Since the fixed section and the flap section together form the eyelet, the flap is in tension when pulled away from the fixed section. It therefore retains the rope or coupling in the eyelet unless intentionally pulled away from the fixed section. In order to ensure that the flap remains in a closure position under conditions of use, the fixed section and the flap section include securing means that encircles both structures. The securing means may be a grommet placed about the perimeter of the stick and held in place with one or more tabs that may be formed as part of the stick.

The modified stick of the present invention is preferably made of a nonmetallic material such as Delrin™, nylon, polyethylene, or other material suitable to withstand a marine environment for extended periods of time. The material selected preferably has "memory" so that the flap returns to its manufactured position with respect to the fixed section after being pulled outwardly to accept or remove a rope loop or an intermediate coupling. The use of a securing means ensures that the flap will be unintentionally drawn away from the fixed section so as to dislodge the rope from the stick and its buoy.

These and other advantages of the present invention will be understood upon review of the drawings, the detailed description, and the appended claims.

DETAILED DESCRIPTION OF THE PREFERRED EMBODIMENTS

Figure 1:
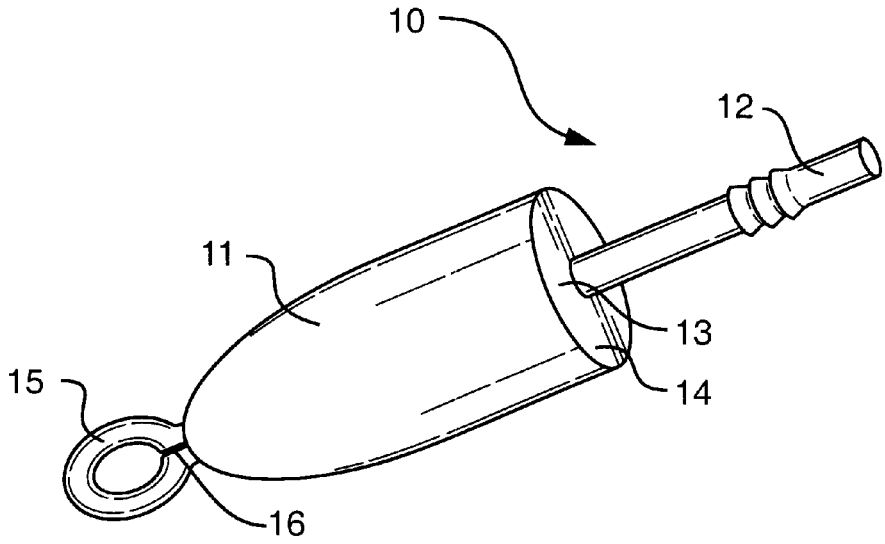
FIG. 1 is a perspective view of the bottom loop buoy stick of the present invention in a first arrangement with a buoy.

A bottom loop buoy stick 10 of the present invention is shown in FIG. 1 in combination with a buoy 11. The stick 10 includes a primary upper section 12 that passes through a through port 13 of the buoy 11 and is retained, at least in part, by an upper grommet 14. The buoy 11 is of any type requiring a removable stick such as stick 10 to couple the buoy 11 to an underwater structure via a connector such as a rope. The stick 10 further includes an eyelet 15 designed to retain either a rope or an intermediate coupling to which a rope may be attached. The eyelet 15 as shown in FIG. 1 includes an upper eyelet slot 16 representing a portion of two lower sections of the stick 10 that make up the novel flap arrangement of the invention.

Figure 2:
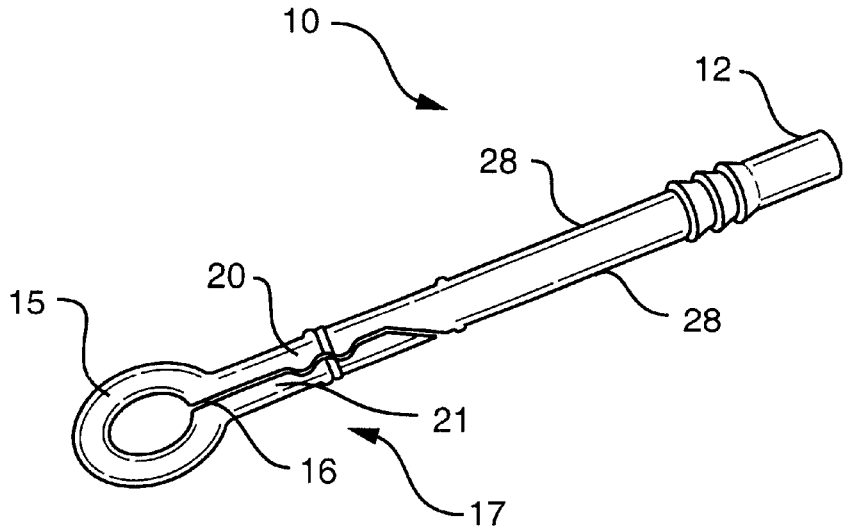
FIG. 2 is a side view of the buoy stick of the present invention.
Figure 3:
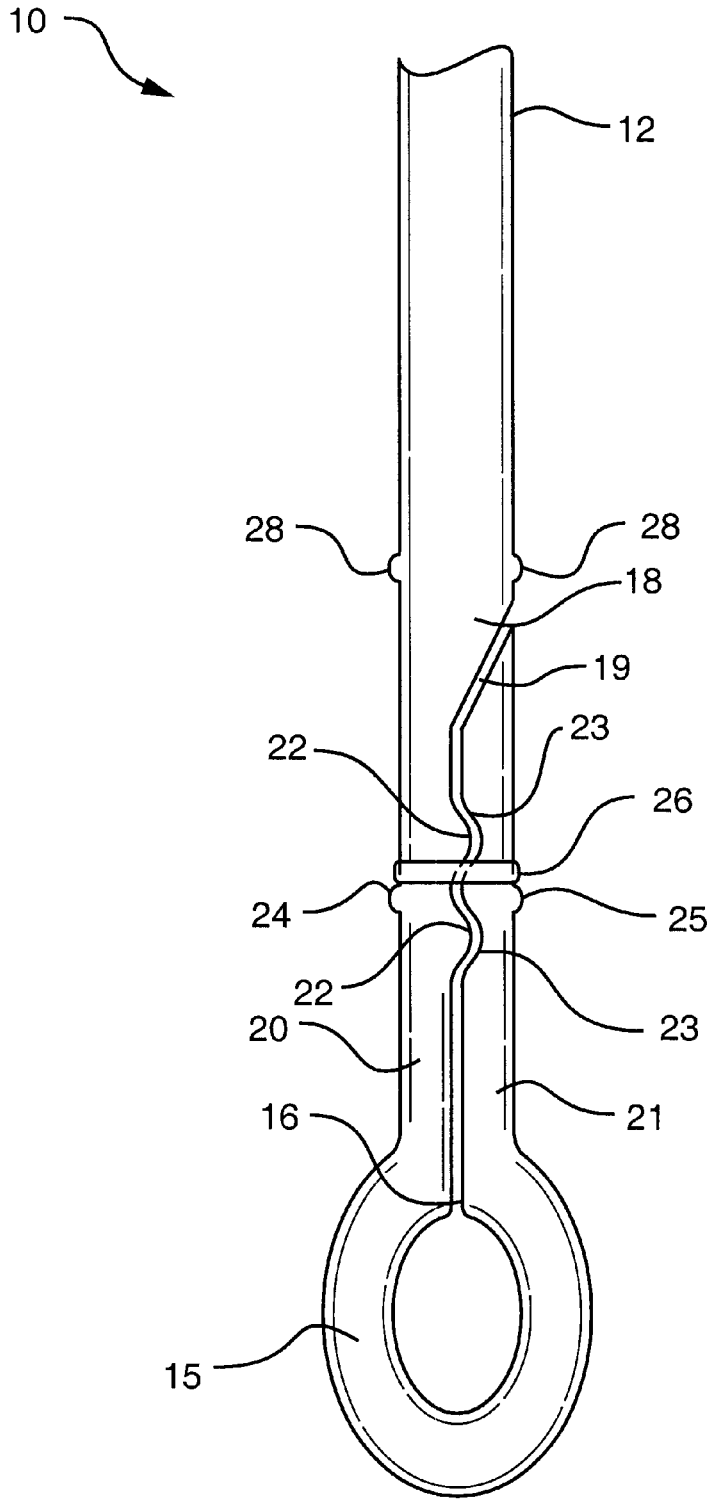
FIG. 3 is a closer side view of the primary lower section of the buoy stick of the present invention.

As illustrated in FIGS. 2 and 3, the stick 10 includes the primary upper section 12 and a primary lower section 17 that includes the eyelet 15. The upper section 12 may be of any selected length such that the overall length of the stick 10 corresponds with that which is used in marine applications such as lobstering. The upper section 12 is preferably a unitary solid body that may be of a single diameter, or that may be stepped down to a plurality of diameter dimensions. The upper section 12 further includes one or more wings or tabs 28 that may be used to retain the upper grommet 14 and thus prevent the stick 10 from exiting the buoy 11.

The primary lower section 17 includes a notched region 18 that defines a split 19, separating a fixed lower section 20 of the lower section 17 from a movable flap section 21. The fixed lower section 20 includes one or more flanges 22 that correspond in location and number with one or more retaining grooves 23 within which the flanges 22 reside when the fixed section 20 and the flap section 21 are proximate with one another. The arrangement of the flanges 22 and the retaining grooves 23 ensures that the fixed section 20 and the flap section 21 remain in association with one another and do not become offset from one another. In that way, the orientation of the eyelet 15 is maintained when the stick 10 is in use. The fixed section 20 further includes on its perimeter one or more fixed section tabs 24 and the flap section 21 includes on its perimeter one or more flap section tabs 25. Together, the tabs 24 and 25 may be used to retain thereon a capturing grommet or bushing 26 that ensures the flap section 21 will not unexpectedly separate from the fixed section 20 when the stick 10 is in use.

The stick 10 is fabricated of a nonmetallic material using a suitable molding technique well known to those skilled in plastics fabrication so that the fixed section 20 and the flap section 21 are spaced from one another substantially as shown. In addition, the stick 10 is fabricated such that the flap section 21 has memory. Specifically, the stick 10 is designed and made so that the flap section 21 may be forcibly pulled away from the fixed section 20 to receive a rope or coupling in the expanded split 19 for passage down to the eyelet 15. After the rope or coupling has been positioned in the eyelet 15, the flap section 21 has sufficient memory so that it will return to its original position, with the flanges 22 and the retaining grooves 23 in coupling connection with one another. In that regard, the flap section 21 may be of thinner dimensions than the fixed section 20.

Figure 4:
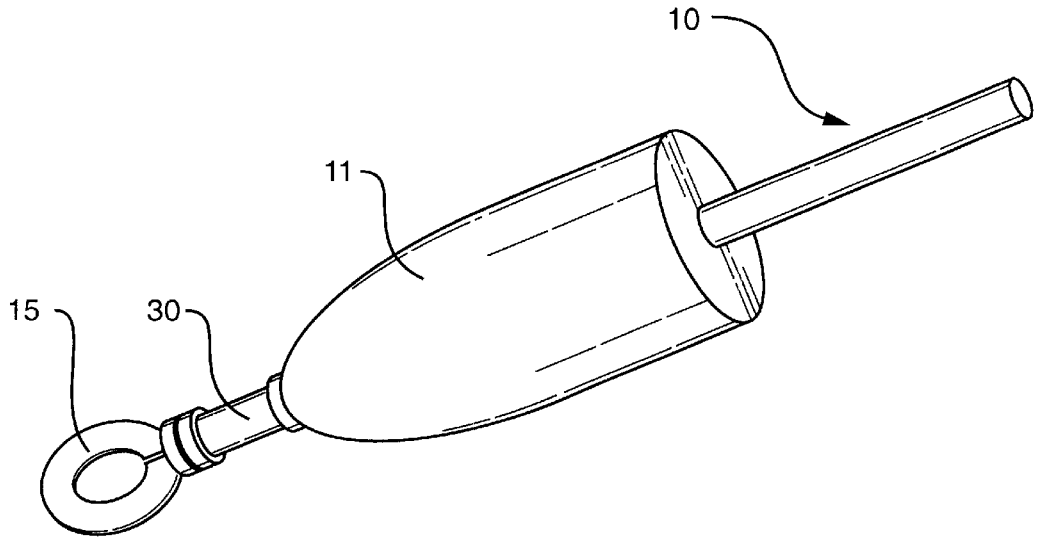
FIG. 4 is a perspective view of the bottom loop buoy stick of the present invention in a second arrangement with a buoy, showing an intermediate spacing insert between the eyelet and the buoy.
Figure 5:
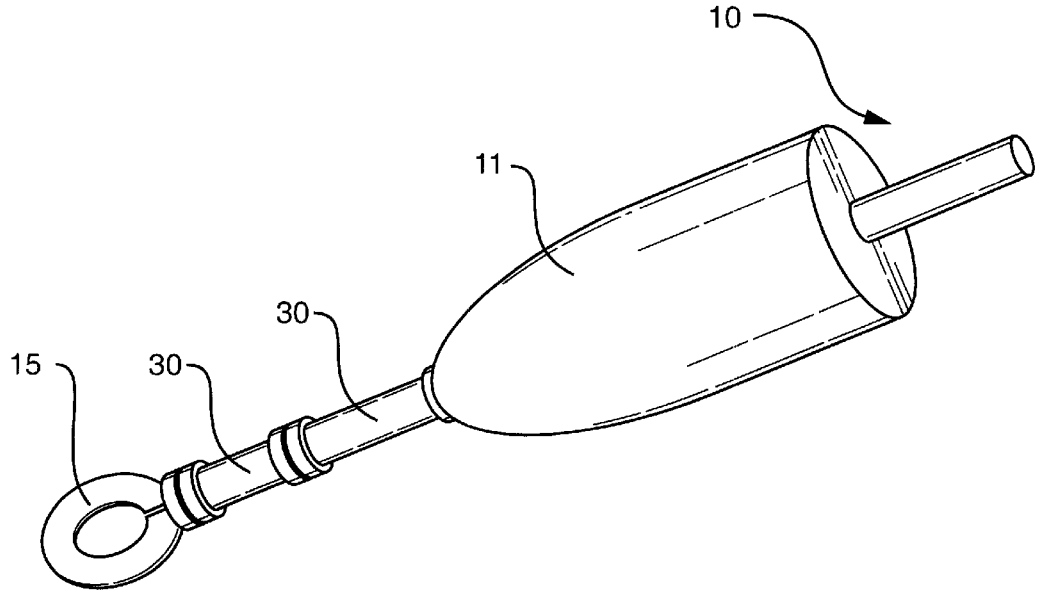
FIG. 5 is a perspective view of the bottom loop buoy stick of the present invention in a third arrangement with a buoy, showing a pair of intermediate spacing inserts between the eyelet and the buoy.

The stick 10 may be of selectable length and may be used in conjunction with buoys of varying dimensions. When the user wishes to ensure that the buoy 11 is spaced in relation to the stick 10 where desired, one or more spacing inserts, such as a sleeve or spacing insert 30 shown in FIG. 4 or a plurality of spacing inserts 30 as shown in FIG. 5, may be inserted between a bottom section 31 of the buoy 11 and the eyelet 15. The spacing insert 30 may be fabricated of any material, but is preferably fabricated of a non-metallic material capable of withstanding a marine environment for extended periods of time. The spacing insert 30 may be fabricated of a selectable length to assist in setting the position of the buoy 11 on the stick 10. The insert 30 is an annular structure fabricated with an inner diameter of dimension sufficient to ensure that the stick 10 will pass through it but smaller enough so that it will not pass over the eyelet 15.

The stick 10 of the present invention is an improvement over existing buoy sticks in that it makes easier the task of placing and removing couplings or rope in relation to the eyelet 15. While the invention has been described with reference to particular example embodiments, it is intended to cover all modifications and equivalents as described in the following claims.

What is claimed is:

1. A buoy stick for retaining a buoy thereon, the buoy stick comprising a primary upper section and a primary lower section, wherein said primary lower section includes a fixed section coupled to said primary upper section and a flap section adjacent to said fixed section, wherein said fixed section and said flap section terminate in a common eyelet, and wherein said flap section is of sufficient flexibility to permit its forced movement away from said fixed section to establish a space therebetween to permit a coupling to pass into and out of said eyelet and to return substantially to its position of origin adjacent to said fixed section upon release of the forced movement away from said fixed section.

2. The buoy stick as claimed in claim 1 wherein said fixed section includes one or more flanges and said flap section includes one or more grooves, wherein said one or more flanges are arranged to fit into a corresponding number of said one or more grooves.

3. The buoy stick as claimed in claim 2 wherein said primary upper section includes a notched region that is a transition section between said primary upper section and said fixed section of said primary lower section.

4. The buoy stick as claimed in claim 2 wherein said primary upper section, said fixed section and said flap section each includes one or more tabs for removably retaining thereon retaining bushings for retaining the buoy to the stick.

5. The buoy stick as claimed in claim 2 fabricated of a non-metallic material.

6. The buoy stick as claimed in claim 5 wherein the buoy stick is fabricated of nylon.

7. The buoy stick as claimed in claim 6 wherein said primary upper section, said fixed section and said flap section are fabricated as a unitary part.

8. The buoy stick as claimed in claim 2 wherein said flap section is fabricated with thinner dimensions than said fixed section.

9. The buoy stick as claimed in claim 1 further comprising one or more spacing inserts for placement between the buoy and said eyelet.

10. The buoy stick as claimed in claim 1 wherein said fixed section and said flap section are configured with outer dimensions that when adjacent to one another the buoy can pass thereover.

11. A buoy stick for retaining a buoy thereon, the buoy stick comprising a primary upper section and a primary lower section, wherein said primary lower section includes a fixed section coupled to said primary upper section and a flap section adjacent to said fixed section, wherein said fixed section and said flap section terminate in a common eyelet, wherein said flap section is of sufficient flexibility to permit its forced movement away from said fixed section to establish a space therebetween to permit a coupling to pass into and out of said eyelet and to return substantially to its position of origin adjacent to said fixed section upon release of the forced movement away from said fixed section, and wherein said primary upper section, said fixed section and said flap section each includes one or more tabs for removably retaining thereon retaining bushings for retaining the buoy to the buoy stick.

12. The buoy stick as claimed in claim 11 wherein the buoy stick is fabricated of a non-metallic material.

13. The buoy stick as claimed in claim 12 wherein the non-metallic material is polyethylene.

14. The buoy stick as claimed in claim 11 wherein said primary upper section, said fixed section and said flap section are fabricated as a unitary piece.

15. The buoy stick as claimed in claim 11 further comprising one or more spacing inserts placeable between the buoy and said eyelet.

* * * * *